US007437862B2

(12) United States Patent
van der Werff

(10) Patent No.: US 7,437,862 B2
(45) Date of Patent: Oct. 21, 2008

(54) MACHINE AND METHOD FOR INSERTING SHEETS INTO ENVELOPES

(75) Inventor: Jeichienus Adriaan van der Werff, Montfoort (NL)

(73) Assignee: NEOPOST Technologies, Bagneux (FR)

( * ) Notice: Subject to any disclaimer, the term of this patent is extended or adjusted under 35 U.S.C. 154(b) by 0 days.

(21) Appl. No.: 11/024,386

(22) Filed: Dec. 28, 2004

(65) Prior Publication Data

US 2005/0160703 A1 Jul. 28, 2005

(30) Foreign Application Priority Data

Dec. 31, 2003 (NL) ..... 1025158

(51) Int. Cl.
*B65B 43/26* (2006.01)

(52) U.S. Cl. ..... 53/569; 53/284.3; 53/381.7; 53/473

(58) Field of Classification Search ..... 53/58, 53/284.3, 381.3, 381.5, 381.7, 530, 569, 53/473

See application file for complete search history.

(56) References Cited

U.S. PATENT DOCUMENTS 3,162,435 A 12/1964 Rastorguyeff et al. ..... 271/2
3,797,196 A * 3/1974 Harbison ..... 53/55
3,910,007 A 10/1975 Dorer ..... 53/58
3,996,727 A * 12/1976 Irvine et al. ..... 53/381.7
4,649,691 A * 3/1987 Buckholz ..... 53/53
4,715,164 A * 12/1987 Luperti et al. ..... 53/381.7
4,813,209 A 3/1989 Foster et al. ..... 53/381 R
4,852,334 A 8/1989 Auerbach ..... 53/569
4,903,456 A 2/1990 Meur ..... 53/69
4,909,021 A * 3/1990 Barbour ..... 53/492
5,251,425 A * 10/1993 Kern ..... 53/460
5,255,498 A * 10/1993 Hotchkiss et al. ..... 53/569
5,410,860 A 5/1995 Coudray et al. ..... 53/569
5,415,068 A * 5/1995 Marzullo ..... 53/492
5,487,254 A * 1/1996 Dronsfield ..... 53/381.7
5,511,357 A * 4/1996 Ricketts et al. ..... 53/55
5,618,375 A * 4/1997 Suzuki et al. ..... 156/442.3
5,675,959 A * 10/1997 Hamma et al. ..... 53/381.1
5,729,954 A * 3/1998 Lines et al. ..... 53/381.7

(Continued)

FOREIGN PATENT DOCUMENTS

DE 1 009 059 5/1957

(Continued)

*Primary Examiner*—Thanh K Truong
(74) *Attorney, Agent, or Firm*—Sughrue Mion, PLLC

(57) ABSTRACT

An inserting machine with an assembly (7) for unfolding a flap (8) of an envelope (9), including: a scraper (20) with a sharp scraping end (21) and an envelope carrier (23-26) as well as a drive (27, 29) for moving the holder portion (18) and the scraper (20) relative to each other, such that the holder portion (18) with the fold edge (17) in trailing position scrapes along the scraping end (21), the scraper (20) scrapes the flap (8) in the area of its free edge (19) off the holder portion (18), and pivots the flap (8) open about the fold edge (17). The scraping end (21) moves along a circulation path (30), of which a first portion (31) extends in a direction towards the fold edge (17) over the holder portion (18) of the envelope (9) and of which a second, contiguous portion (32) diverges from the holder portion (18) of the envelope (9).

10 Claims, 2 Drawing Sheets

U.S. PATENT DOCUMENTS

| | | | | |
|---|---|---|---|---|
| 5,802,808 | A | 9/1998 | Lyga | 53/381.5 |
| 5,809,749 | A | 9/1998 | Ruggiero et al. | 53/473 |
| 5,867,976 | A | 2/1999 | Ziegler, Jr. | 60/39.33 |
| 5,950,399 | A * | 9/1999 | Viens et al. | 53/381.6 |
| 6,036,185 | A | 3/2000 | Baumann et al. | 271/2 |
| 6,199,348 | B1 | 3/2001 | Button et al. | 53/460 |
| 6,219,647 | B1 * | 4/2001 | Hidding et al. | 705/1 |
| 6,293,076 | B1 * | 9/2001 | Miller et al. | 53/460 |

FOREIGN PATENT DOCUMENTS

| | | | |
|---|---|---|---|
| DE | 1 461 694 | 3/1969 | |
| EP | 0 392 867 | 10/1990 | |
| JP | 406166297 A * | 6/1994 | 271/2 |
| WO | WO 95/16578 | 6/1995 | |

* cited by examiner

MACHINE AND METHOD FOR INSERTING SHEETS INTO ENVELOPES

CROSS-REFERENCE TO RELATED APPLICATION

This patent application claims priority from Dutch Patent Application No. 1025158, filed Dec. 31, 2003.

FIELD AND BACKGROUND OF THE INVENTION

The invention relates to an inserting machine for inserting sheets into an envelope.

Such a machine and such a method are known from U.S. Pat. No. 3,910,007. In the machine and method described in that publication, the scraper engages the flap of the envelope passing with the fold edge between the flap and the holder portion of the envelope in trailing position. The scraper can be kept away from the path of the envelope in order to prevent its engaging the leading edge of the supplied envelope.

This method and apparatus have a number of inherent drawbacks. Firstly, the free edge of the flap can easily be missed, in particular if it adheres somewhat to the envelope, if the envelope is being conveyed at high speed, and if the free edge of the flap is situated close to the leading edge of the envelope, so that the scraper, after pivoting against the envelope, can easily bounce over the free edge of the flap. The scraper can also bounce easily over the free edge of the flap if the envelope or its content has unevennesses which pass the scraper shortly before the free edge of the flap reaches the scraper.

Secondly, the envelope can easily be damaged in the area of the fold, in particular if the envelope moves at high speed relative to the scraper. To prevent such unwanted effects, the scraper is provided with a blunt edge which protrudes further towards the fold edge than a sharp edge in a central area of the scraper, where it first engages the flap. This, however, makes the scraper unsuitable for processing envelopes whose flap has a free edge that is straight over a great width.

SUMMARY OF THE INVENTION

It is an object of the invention to make it possible, with a simple construction, to open the flap of a supplied envelope in an inserting machine, prior to placement of one of more sheets in the envelope, more reliably and with less chance of the envelope being damaged.

According to the invention, this object is realized by providing an inserting machine for inserting sheets into an envelope. The inserting machine has an assembly for unfolding a flap of an envelope, which flap is connected with a holder portion of the envelope along a fold edge, has a free edge on a side situated remote from the fold edge, and is folded as far as its free edge against the holder portion. The inserting machine further includes a scraper with a sharp scraping end and an envelope carrier, for scraping at least a portion of the flap remote from the fold edge off the holder portion and a drive for moving the holder portion and the scraper relative to each other, such that the holder portion with the fold edge in trailing position scrapes along the scraping end, the scraper scrapes the flap in the area of its free edge off the holder portion, and pivots the flap open about the fold edge. The scraper is suspended and coupled to a scraper drive for causing the scraping end to move along a circulation path, of which a first portion extends in a direction towards the fold edge over the holder portion of the envelope and of which a second, contiguous portion diverges from the holder portion of the envelope.

Owing to the scraper moving along a circulation path, of which a first portion extends in a direction towards the fold edge over the holder portion of the envelope, at least a portion of the holder portion of the envelope is scraped several times, so that the chance of the free edge of the flap being missed is limited. Owing to the scraper or scrapers then diverging away from the holder portion of the envelope in a second portion of the path, contiguous to the first portion of the path, the flap is actively pivoted open, so that the chance of damage of the envelope, and in particular the flap in the area of the fold edge, is limited.

Particular embodiments of the invention are set forth in dependent claims.

Further aspects, effects and details of the invention are described below and elucidated with reference to an exemplary embodiment represented in the drawing.

DETAILED DESCRIPTION

Figure 1:
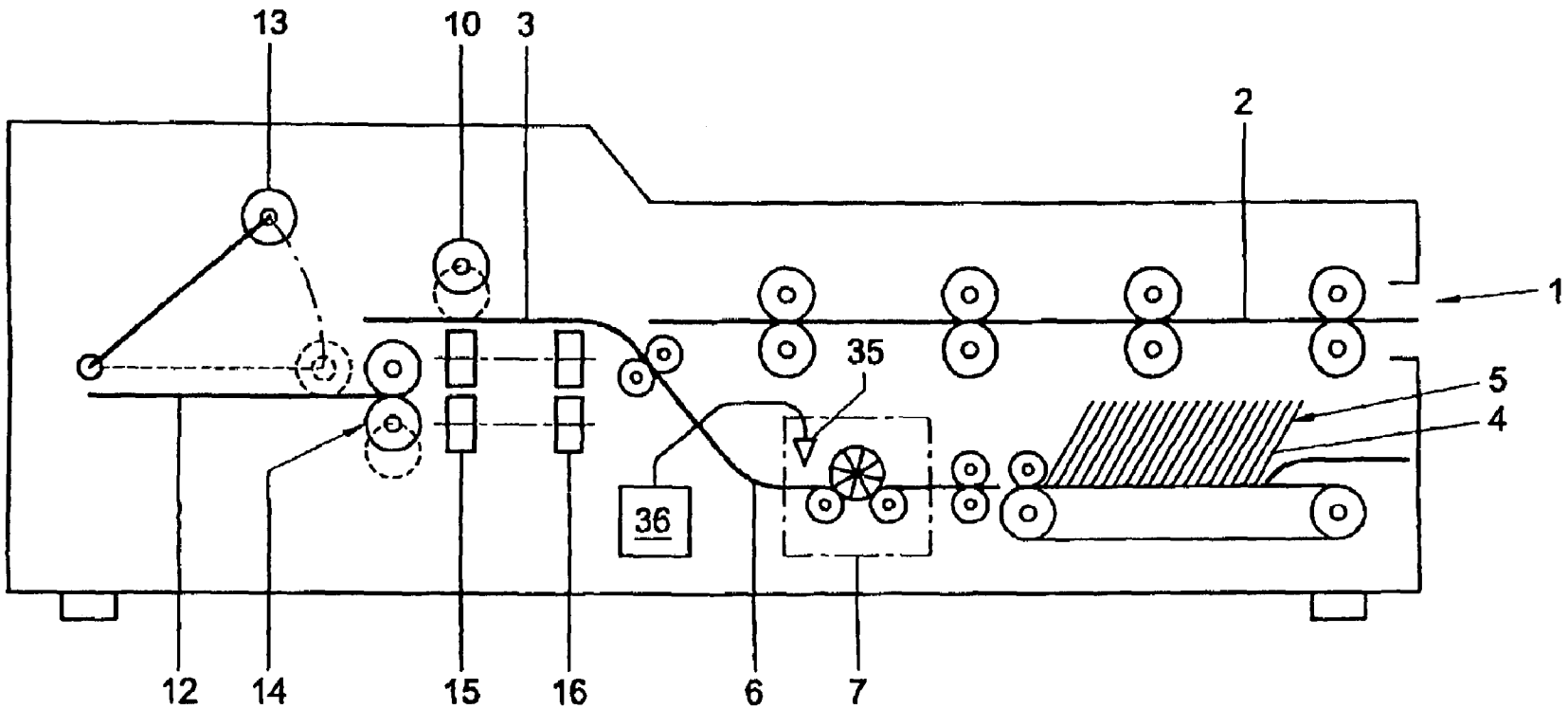
FIG. 1 is a schematic representation in side elevation of an exemplary inserting machine according to the invention.
Figure 2:
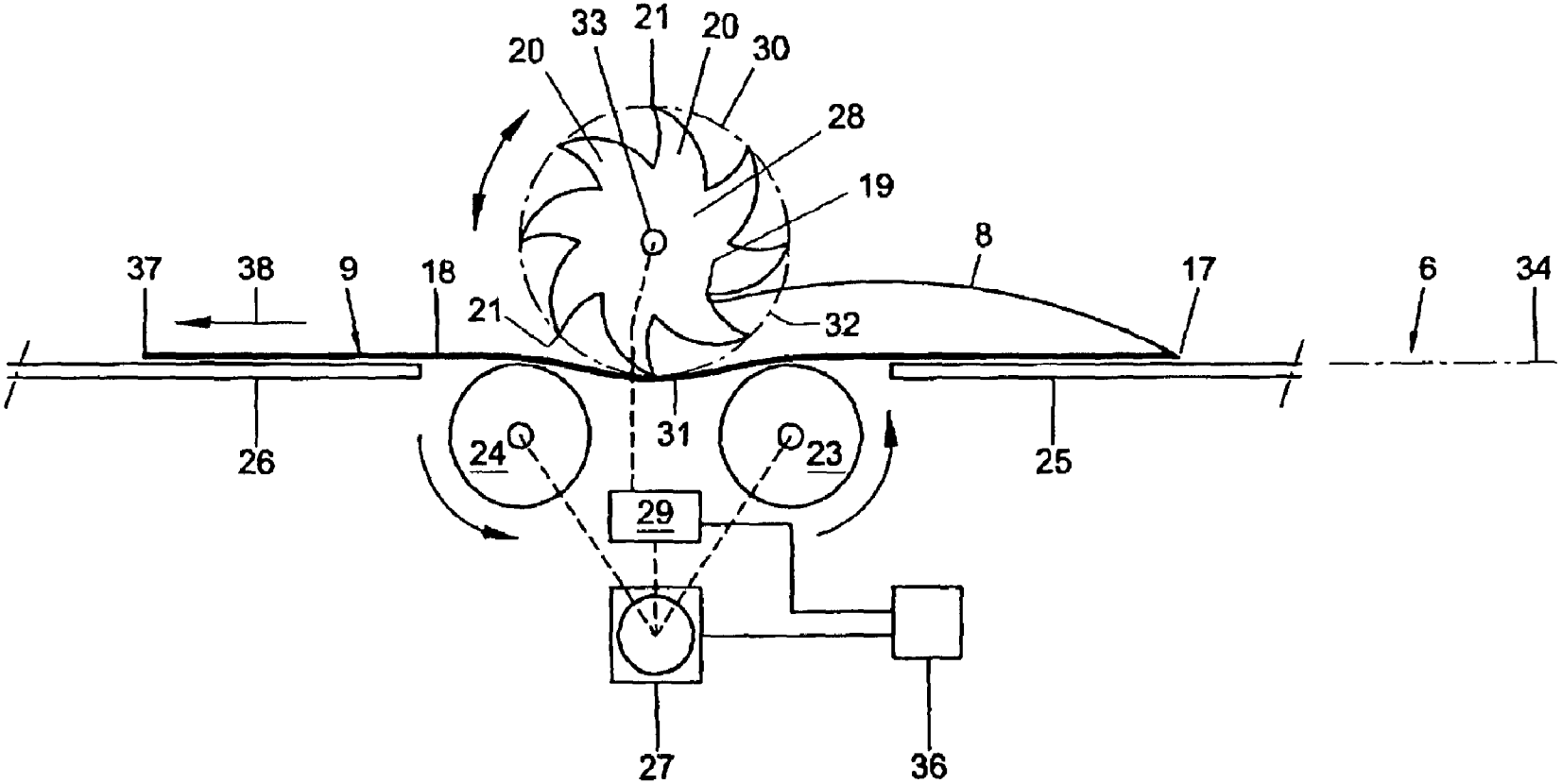
FIG. 2 is a schematic, cutaway representation in side elevation of a portion of the inserting machine according to FIG. 1 for opening the flap of an envelope.

The inserting machine according to the example represented in the drawing has an inlet 1 via which sheets, or sets each consisting of several sheets, can be supplied. From the inlet 1 extends a transport path 2 to a filling position 3 where envelopes can be filled in succession. A holder 4 for accommodating a supply 5 of envelopes to be filled is situated under the transport path 2. From the holder 4 extends a transport path 6, also to the filling position 3. The transport path extends through an assembly 7 for opening the flap 8 of an envelope 9 which has been supplied.

For discharging envelopes 9 from the filling position, a lowerable transport roller 10 is suspended above the filling position. Provisions for closing the flap of the envelope 9 comprise a lowered platform 12, situated behind a step 11, and a press-down roller 13, with which envelopes 9 can be pressed to the platform 12 and subsequently transported to a pair of sealing rollers 14 under the filling position 3. A moistener for moistening the gummed edge of the envelope is not represented for the sake of simplicity. Of the sealing rollers 14, the lower one is retractable. When the lower one of the sealing rollers 14 is retracted and the press-down roller 13 has been lifted off the envelope 9, this envelope 9 is released for transport in a direction transverse to the transport paths 2 and 6 by pairs of transport rollers 15, 16, which, prior to receiving the envelope 9 between them, are situated remote from each other, and for the purpose of discharging the envelope 9 are pressed towards each other and are driven.

The flap 8 of the envelope 9 is connected with a holder portion 18 of the envelope 9 along a fold edge 17. On a side remote from the fold edge 17, the flap 8 has a free edge 19. Prior to being opened, the flap 8 may to some extent be directed away from the holder portion 18 but in many cases it abuts as far as its free edge 19 against the holder portion 18.

The assembly for opening the flap 8 of the envelope 9 is equipped with circumferentially distributed scrapers 20, each having a sharp scraping end 21. In this example, an envelope carrier is formed by two sets of transport rollers 23, 24 and two guide plates 25, 26 upstream and downstream of the scrapers 20, on which rollers 23, 24 and plates 25, 26 the envelope 9 is supported.

A motor 27 is coupled to the transport rollers 23, 24 and is coupled, via a reverse clutch 29, to a roller 28, of which the scrapers 20 form a part. Thus, a drive is formed for moving the holder portion 18 and the scrapers 20 relative to each other, such that the holder portion 18, with the fold edge 17 in trailing position, scrapes along the scraping ends 21 for scraping at least a portion of the flap 8 remote from the fold edge 17 away from the holder portion 18. The scrapers 20 pivot the flap 8 in the area of its free edge 19 off the holder portion 18, so that the flap 8 pivots open about the fold edge 17.

Owing to the scrapers 20 being suspended and coupled to the drive 27, 29 for causing the scraping end 21 of the scrapers 20 to move in a circulation path 30, of which a first portion 31 extends in a direction towards the fold edge 17 over the holder portion 18 of the envelope 9 and a second, contiguous portion 32 diverges from the holder portion 18 of the envelope 9, the flap 8 is reliably scraped off the holder portion 18 and in an early stage actively pivoted away from the holder portion 18, so that the risk of damage of the envelope 9 in the area of the fold edge 17 is limited.

If the free edge of the flap 8 does not immediately engage one of the scrapers 20, there is at least a second chance of the next scraper 20 catching the flap 8. It is possible to provide just one scraper which is movable along a path in a circulation sense as described. According to this example, however, there are several of the scrapers 20 provided, spaced apart in a circulation sense and suspended for movement along the circulation path 30. This provides the advantage that the chance that the flap 8 is missed is further limited, in that at a given number of revolutions per unit time more scrapers are moved over the surface of the holder portion 18.

Owing to the circulation path 30 being a circular path about an axis 33 parallel to an envelope plane defined by the envelope carrying structure 23-26, the movement along the circulation path 30 is realized in a constructionally simple manner. What further promotes simplicity of construction is the scrapers 20 forming a toothed roller 28.

The scrapers 20 are then designed as teeth directed obliquely radially and tangentially in a circulation sense, so that they reliably engage the free edge 19 of the flap 8.

The circulation path 30 intersects an envelope plane 34 defined by the envelope carrying parts 23-26, for causing the envelope 9 to bend between the transport rollers 23, 24. As a result of this bending of the envelope 9, it is bent away from the flap 8, so that the free edge 19 of the flap 8 to some extent comes clear of the holder portion 18 of the envelope 9, and the scrapers 20 can engage the free edge 19 of the flap 8 with still greater reliability. Moreover, the circulating ends 21 of the scrapers 20, when they reach the bent envelope 9, tap against the envelope 9, which further promotes the flap 8 coming off the holder portion 18.

The inserting machine has an envelope transport detector 35 for determining when a leading edge of an envelope 9 that is being supplied has reached the path 30 of the scrapers 20. According to this example, this detector 35 is designed as a light-sensitive sensor responsive to interruption of light coming from an opposed light source. It is also possible, however, to detect the passage of the leading edge of an envelope in a different manner, for instance by recording the distance over which an envelope has moved since leaving the holder 4, based on angular displacements of an element of the transport drive.

The reverse clutch 29 and the detector 35 are coupled to a control 36 which is arranged for causing the scrapers 20, prior to the above-described movement in the circulation sense whereby the scraper ends move in a direction towards the fold edge 17 over the holder portion 18 of the envelope 9, to move in an opposite circulation sense, by rotating the roller 28 in the opposite sense. Further, the control 36 is arranged for reversing the circulation sense of the scrapers 20 by driving the clutch 29 for reversing the rotational direction of the roller 28, after the leading edge 37 of the envelope 9 passing in a direction 38 has passed the path of the scrapers 20. The scrapers 20 circulating in the opposite sense before the leading edge 37 of the envelope passes prevents their striking against the leading edge 37 of the envelope 9 being supplied. Consequently, it is not necessary to retract the scrapers 20 when the envelope 9 is being supplied, so that a robust and accurate suspension of the scrapers 20 is simple to realize.

The invention claimed is:

1. An inserting machine for inserting sheets into an envelope, comprising:

an assembly for unfolding a flap of an envelope, which flap is connected with a holder portion of the envelope along a fold edge, has a free edge on a side situated remote from the fold edge, and is folded as far as the flap's free edge against the holder portion;

means for transporting the envelope along a transport path which passes through the assembly, said transporting path including a plurality of supports for conveying the envelope along an envelope feed plane;

a drive for driving displacement of the holder portion along the envelope transport path with the fold edge of the envelope in a trailing position;

wherein the assembly includes:

a scraper roller including a plurality of scraper teeth for unfolding the flap, said scraper roller being rotatably provided between two of said supports and on an opposite side of the envelope feed plane from the two supports; and a scraper drive for rotating the scraper roller in a forward direction in which the scraper teeth unfold the flap, wherein each of the scraper teeth has an arcuate shape curving such that a sharp distal end is directed obliquely radially and tangentially in the forward direction, wherein upon rotation, the distal ends of the teeth define a circulation path which intersect the envelope feed plane such that upon initial contact with the envelope, the distal ends of the scraper teeth apply pressure to the envelope to create a bend in the envelope between the two supports, whereupon at least one of the teeth scrapes the flap in the area of the free edge of the flap of the envelope off the holder portion that is displaced along the envelope transport path, and pivots the flap open about the fold edge.

2. An inserting machine according to claim 1, comprising a plurality of scrapers which are spaced apart in a circulation sense and are suspended for movement along the circulation path.

3. An inserting machine according to claim 2, wherein the scrapers form a toothed roller.

4. An inserting machine according to claim 1, wherein the circulation path is a circulation path about an axis parallel to an envelope plane defined by the envelope carrier.

5. An inserting machine for inserting sheets into an envelope, comprising an assembly for unfolding a flap of an envelope, which flap is connected with a holder portion of the envelope along a fold edge, has a free edge on a side situated remote from the fold edge, and is folded as far as the flap's free edge against the holder portion, comprising:

a scraper with a sharp scraping end and an envelope carrier, for scraping at least a portion of the flap remote from the fold edge off the holder portion;

a drive for moving the holder portion and the scraper relative to each other, such that the holder portion with the fold edge in trailing position scrapes along the scraping end, the scraper scrapes the flap in the area of its free edge off the holder portion, and pivots the flap open about the fold edge, wherein the scraper is suspended and coupled to a scraper drive for causing the scraping end to move along a circulation path, of which a first portion extends in a direction towards the fold edge over the holder portion of the envelope and of which a second, contiguous portion diverges from the holder portion of the envelope; and an envelope transport detector for determining when a leading edge of the envelope, when being supplied, has passed the circulation path, wherein the scraper drive is coupled to a control for causing the scraper or scrapers, prior to the movement in the circulation sense whereby the scraper end or the scraper ends moves or move in a direction towards the fold edge over the holder portion of the envelope, to move in an opposite circulation sense, and for reversing the circulation sense of the scraper or scrapers after the leading edge of the envelope has passed the circulation path.

6. An inserting machine according to claim 5, comprising a plurality of scrapers which are spaced apart in a circulation sense and are suspended for movement along the circulation path.

7. An inserting machine according to claim 6, wherein the scrapers form a toothed roller.

8. An inserting machine according to claim 7, wherein the scrapers are designed as teeth directed obliquely radially and tangentially in a circulation sense.

9. An inserting machine according to claim 5, wherein the circulation path is a circulation path about an axis parallel to an envelope plane defined by the envelope carrier.

10. An inserting machine according to claim 5, wherein the circulation path intersects an envelope plane defined by the envelope carrier for causing the envelope to bend between supports.

* * * * *